US012473139B2

(12) United States Patent
Koh et al.

(10) Patent No.: US 12,473,139 B2
(45) Date of Patent: Nov. 18, 2025

(54) DISPENSING CONSUMABLES

(71) Applicant: QUIP NYC INC., Brooklyn, NY (US)

(72) Inventors: Paul Koh, Brooklyn, NY (US); William Thomas May, Summit, NJ (US); Simon Enever, New York, NY (US); James Krause, Brooklyn, NY (US); Adrian Candela, Brooklyn, NY (US); Jonathan Fratti, Brooklyn, NY (US)

(73) Assignee: QUIP NYC INC., Brooklyn, NY (US)

( * ) Notice: Subject to any disclaimer, the term of this patent is extended or adjusted under 35 U.S.C. 154(b) by 0 days.

(21) Appl. No.: 17/361,042

(22) Filed: Jun. 28, 2021

(65) Prior Publication Data

US 2021/0403225 A1 Dec. 30, 2021

Related U.S. Application Data

(60) Provisional application No. 63/044,758, filed on Jun. 26, 2020.

(51) Int. Cl.
*B65D 83/04* (2006.01)

(52) U.S. Cl.
CPC .. *B65D 83/0418* (2013.01); *B65D 2583/0472* (2013.01)

(58) Field of Classification Search
CPC ..... B65D 83/0418; B65D 2583/0472
USPC ..... 221/229, 198, 271, 232, 269, 268, 270, 221/281, 4; 206/42
See application file for complete search history.

(56) References Cited

U.S. PATENT DOCUMENTS 1,485,716 A * 3/1924 Rogers ..... B65D 83/766 221/185
D148,959 S 3/1948 Ryan
2,620,061 A * 12/1952 Uxa ..... B65D 83/0418 221/229

(Continued)

FOREIGN PATENT DOCUMENTS

DE 40010744 4/2001
EP EU-002453472-0003 8/2014

(Continued)

OTHER PUBLICATIONS

PCT; International Search Report and Written Opinion, International Application No. PCT/US2021/039439; mailed Sep. 23, 2021; 14 pages.

(Continued)

*Primary Examiner* — Rakesh Kumar
(74) *Attorney, Agent, or Firm* — ArentFox Schiff LLP

(57) ABSTRACT

A device for dispensing consumables includes a housing, a drawer, a cap, a latch, and a tooth. The housing may define a volume. The drawer defines a cavity and may be disposed in the volume. The cap may be along the housing. The latch may be securable to hold the cap in a closed position enclosing the volume. In response to a force exceeding a threshold force on the latch, the cap may be movable from the closed position to an open position exposing the volume. The tooth may be mechanically coupled to the latch and, in response to the force exceeding the threshold force on the latch, the tooth may movable in the cavity in a direction directing a consumable unit out of the volume with the cap in the open position.

21 Claims, 7 Drawing Sheets

(56) References Cited

U.S. PATENT DOCUMENTS 2,853,206 A * 9/1958 Uxa ..... B65D 83/0418 221/229
3,112,046 A * 11/1963 Szekely ..... B65D 83/0409 221/312 R
3,410,455 A * 11/1968 Haas ..... B65D 83/0418 221/229
3,511,409 A * 5/1970 Huck ..... B65D 83/0418 221/231
3,515,111 A * 6/1970 Auge ..... F41B 7/00 124/16
3,565,284 A * 2/1971 Hinterreiter ..... B65D 83/0418 221/229
3,650,439 A * 3/1972 Shimooka ..... G01F 11/261 222/456
3,844,445 A * 10/1974 Haas ..... B65D 83/0418 221/229
3,845,882 A * 11/1974 Hass ..... B65D 83/0418 221/229
3,854,625 A * 12/1974 Kuebler ..... B65D 83/0409 221/307
3,942,683 A * 3/1976 Haas ..... B65D 83/0418 221/229
4,171,753 A * 10/1979 Vreede ..... B65D 83/0418 221/229
4,295,579 A * 10/1981 Haas ..... B65D 83/0418 221/229
4,311,251 A * 1/1982 Sternberg ..... B65D 83/0418 221/229
D270,028 S 8/1983 Vernin
4,530,445 A * 7/1985 Decker ..... B43M 99/009 221/280
4,589,575 A * 5/1986 Rigberg ..... B65D 83/0418 221/269
4,966,305 A * 10/1990 Hinterreiter ..... B65D 83/0418 221/229
4,986,442 A * 1/1991 Hinterreiter ..... B65D 83/0418 221/229
5,012,936 A * 5/1991 Crum ..... A47F 1/126 206/556
5,048,720 A * 9/1991 Hoke ..... B65D 83/0418 221/229
5,071,033 A * 12/1991 Siwek ..... B65D 83/0409 221/229
5,080,258 A * 1/1992 Hinterreiter ..... B65D 83/0418 221/229
5,081,778 A * 1/1992 Switzer ..... F41A 9/66 42/50
5,118,007 A * 6/1992 Lewis ..... B65D 83/049 206/536
5,178,298 A * 1/1993 Allina ..... B65D 83/0418 221/229
D333,975 S 3/1993 Moore
5,230,440 A * 7/1993 Kurokawa ..... B65D 83/0418 221/232
5,366,112 A * 11/1994 Hinterreiter ..... B65D 83/0418 221/229
5,560,516 A * 10/1996 Hinterreiter ..... B65D 83/0418 221/277
5,617,973 A * 4/1997 Seto ..... G01N 35/00029 221/56
5,785,206 A * 7/1998 Chan ..... G07F 11/14 221/269
5,878,895 A * 3/1999 Springs ..... A47F 1/126 211/74
6,220,479 B1 * 4/2001 Fishman ..... B65D 83/0409 221/24
D456,952 S 5/2002 Sakurai et al.
6,425,495 B1 * 7/2002 Senda ..... B65D 83/0418 221/24
6,543,639 B1 * 4/2003 Kovens ..... G07F 11/22 221/217
6,564,967 B1 * 5/2003 Stringfield ..... B65D 83/0418 221/229
D499,653 S 12/2004 Karim
6,840,402 B2 * 1/2005 Lin ..... G01J 5/021 374/E1.013
6,889,869 B2 * 5/2005 Hallin ..... A61J 7/0076 221/270
D532,557 S 11/2006 Bakic
D532,936 S 11/2006 Bakic
D537,620 S 3/2007 Glennie
7,207,464 B2 * 4/2007 Brenner ..... B65D 83/049 221/303
7,246,720 B1 * 7/2007 Montoya, Jr. ..... A61F 6/005 221/229
D555,000 S 11/2007 Bunce et al.
D561,594 S 2/2008 Condon et al.
D585,298 S 1/2009 Yakoby
7,523,841 B2 * 4/2009 Konig ..... B65D 83/0418 221/24
D592,460 S 5/2009 Long et al.
D592,462 S 5/2009 Long et al.
7,533,483 B1 * 5/2009 Alzamora ..... F41A 9/65 89/197
7,749,191 B2 * 7/2010 Truax ..... A61M 15/0003 604/90
D620,808 S 8/2010 Gieux
D650,696 S 12/2011 Peden, III et al.
D669,791 S 10/2012 Peden, III et al.
D683,902 S 6/2013 Zotalis
D691,889 S 10/2013 Mettler et al.
D708,524 S 7/2014 White et al.
D739,077 S 9/2015 Kloman et al.
D741,004 S 10/2015 Kloman et al.
D757,565 S 5/2016 Partrat
D779,124 S 2/2017 Houyoux
9,738,433 B2 * 8/2017 Hogg ..... H01M 50/264
D808,804 S 1/2018 Swint et al.
9,932,166 B2 * 4/2018 Marqua ..... A61J 7/0076
10,071,846 B2 * 9/2018 Yao ..... B65D 83/0829
D875,533 S 2/2020 Fazlagic
D892,624 S 8/2020 Son et al.
D908,964 S 1/2021 May et al.
D928,409 S 8/2021 May et al.
2004/0007585 A1 * 1/2004 Griffith ..... G01N 33/48757 221/232
2007/0125794 A1 * 6/2007 Jones ..... G07F 11/20 221/231
2010/0084419 A1 * 4/2010 Haas ..... B65D 83/0418 221/1
2010/0147870 A1 * 6/2010 Reynolds ..... A61B 5/150358 221/232
2011/0278195 A1 * 11/2011 Giocastro ..... B65D 51/28 206/528
2011/0290682 A1 * 12/2011 Gibson ..... B65D 77/20 206/265
2013/0263424 A1 * 10/2013 Giocastro ..... B65D 51/28 29/428
2013/0292403 A1 * 11/2013 Cote ..... B65D 21/0204 221/92
2014/0076916 A1 * 3/2014 Boyce ..... A47K 10/3827 221/34
2014/0219626 A1 * 8/2014 Weber ..... H05K 5/03 361/679.01
2014/0360898 A1 * 12/2014 Kantor ..... A45C 11/00 206/216
2015/0113747 A1 4/2015 Mey et al.
2017/0013880 A1 * 1/2017 O'Brien ..... A61M 11/042
2019/0231063 A1 8/2019 May et al.
2020/0206084 A1 * 7/2020 Tsukanov ..... A61J 1/03
2021/0403225 A1 * 12/2021 Koh ..... B65D 83/0418

FOREIGN PATENT DOCUMENTS

EP EU-008369797-0001 2/2021
EP EU-008369797-0002 2/2021
RU 128220 11/2021
WO 2008/074177 A 6/2008

(56) References Cited

FOREIGN PATENT DOCUMENTS

| | | | | |
|---|---|---|---|---|
| WO | WO-2008074177 | A1 * | 6/2008 | ..... B65D 83/0418 |
| WO | 2014/090317 | A | 6/2014 | |
| WO | WO-2014090317 | A1 * | 6/2014 | ..... B65D 83/0418 |
| WO | 2016/072912 | A | 5/2016 | |
| WO | WO-2016072912 | A1 * | 5/2016 | ..... B65D 43/169 |

OTHER PUBLICATIONS

Gum Starter Kit; Quip, getquip.com, published by Quip on Dec. 3, 2020 per wayback machine © 2021 Quip, online site visited Aug. 23, 2021, Available at URL: https://www.getquip.com/store/products/gum (year 2021) 16 pages.

Gas Torch Jet Lighter, brand unlisted, articulo.mercadolibre.cl, author and date unlisted © 1999-2021 Mercado Libre Chile Ltda., online, site visited Aug. 23, 2021. Available at URL: https://articulo.mercadolibre.cl/MLC-633414855-2021-antorcha-gas-encendedor-jet-cocina-parrilla-turbina . . . (Year: 2021) 4 pages.

USB Lighter, NAMCHE, amazon.com, published by NAMCHE on Apr. 7, 2019 © 1996-2021 Amazon.com, Inc., online, site visited Aug. 23, 2021. Available at URL: https://www.amazon.com/NAMCH E-USB-Lighter-Rechargeable-Electronic/dp/B07RWLX9CF . . . (Year 2019) 16 pages.

USPTO, Non-Final Office Action dated Sep. 14, 2021 for U.S. Appl. No. 29/739,588 11 pages.

The International Burreau of WIPO, "International Preliminary Report on Patentability," issued in related International Patent Application No. PCT/2021/039439 mailed Jan. 5, 2023 (8 pages).

National Institute of Industrial Property, "Office Action," issued in related Brazilian Patent Application No. 302020006176-4, dated Apr. 27, 2021 (2 pages).

Canadian Intellectual Property Office, "Examination Report," issued in related Canadian Patent Application No. 200194, dated Apr. 13, 2022 (1 page).

China National Intellectual Proeprty Adminstration, "First Notification to Make Rectification," issued in related Chinese Patent Application No. 202030802902.3, dated Apr. 14, 2021, including Foreign Associate English electronic mail forwarding same (10 page).

China National Intellectual Proeprty Adminstration, "Notification of Granting of Industrial Design," issued in related Chinese Patent Application No. 202030802902.3, dated Jun. 18, 2021 (3 pages).

Mexican Institute of Industrial Property, "Notice of Allowance," issued in related Mexican Patent Application No. MX MX/f/2021/000015, dated Jan. 19, 2022, including Foreign Associate English electronic mail forwarding same (5 pages).

Patent Federal Service for Intellectual Property, "Decision to Grant," issued in related Russian Patent Application No. 20P0023774/2020506422, dated Sep. 14, 2021, including Foreign Associate English reporting letter (15 pages).

U.S. Patent and Trademark Office, "Notice of Allowance and Issue Fee(s) Due," issued in related U.S. Appl. No. 29/739,588, dated Feb. 9, 2022 (9 pages).

* cited by examiner

DISPENSING CONSUMABLES

CROSS-REFERENCE TO RELATED APPLICATIONS

This application claims the benefit of priority of U.S. Provisional Patent Application No. 63/044,758, filed on Jun. 26, 2020, the entire contents of which are incorporated herein by reference.

BACKGROUND

Portable dispensing devices are often used for storage and dispensing gum, candy, pills, etc. Such dispensing devices include a storage space where a number of consumable units may be contained. Further, these dispensing devices can protect the consumable units from external elements, temperature, sunlight, high/low humidity, etc.

Some types of dispensing devices require the user to handle the consumable units. For example, some dispensing devices require the user to reach into a container in which the consumable units are stored, with each ingress into the container presenting a potential risk of contamination of the consumable units. As another example, some dispensing devices require the user to flip the container over to move one or more consumable units out of the container. In such instances, it is typically difficult to control the number of consumable units dispensed from the container. In the event that too many consumable units are dispensed, users typically return extra consumable units to the container. Here, again, such manipulation of the consumable units presents its own potential for contamination of the consumable units in the container.

Other types of devices include ratchet mechanisms operable to dispense consumable units. However, consumable units can be difficult to load into such ratchet mechanisms and, in many instances, such ratchet mechanisms make it difficult to maintain sanitary dispensing habits. Further, in addition to being noisy, ratchet mechanisms dispense consumable units with inconsistent and unreliable force, with the force often varying according to the number of consumable units loaded in the dispensing device.

SUMMARY

According to one aspect, a device for dispensing consumables may include a housing defining a volume, a drawer disposed in the volume, the drawer defining a cavity, a cap along the housing, a latch securable to hold the cap in a closed position enclosing the volume and, in response to a force exceeding a threshold force on the latch, the cap movable from the closed position to an open position exposing the volume, and a tooth mechanically coupled to the latch and, in response to the force exceeding the threshold force on the latch, the tooth movable in the cavity in a direction directing a consumable unit out of the volume as the cap moves from the closed position to the open position.

In certain implementations, at the threshold force, the force on the latch may be transferrable to the tooth to direct the consumable unit out of the volume as the cap moves from the closed position to the open position.

In some implementations, with the cap in the closed position, the latch may be mechanically coupled to the cap, and the force on the latch is transmittable to the latch via depression of at least a portion of the cap. For example, the cap may include a first section and a second section, the cap is pivotable about a pivot axis between the first section and the second section, and depression of the first section of the cap moves the second section of the cap away from the housing to define an opening exposing the volume. Further or instead, the first section may have a first length pivotable about the pivot axis, the second section has a second length pivotable about the pivot axis, and the first length is less than the second length. Additionally, or alternatively, the cap may be coupled to the drawer at least along the pivot axis. The tooth may be, for example, mechanically coupled to the latch via the cap, and the tooth is movable, about the pivot axis, toward the opening in response to depression of the first section of the cap. As an example, the tooth may be movable into and out of the cavity via movement of the tooth about the pivot axis. In some instances, the device may further include a first spring coupled to the cap, wherein the first spring biases the cap from the open position to the closed position. The first spring may be, for example, a torsion spring rotatable about the pivot axis.

In certain implementations, the housing may circumscribe the cap in the closed position.

In some implementations, with the drawer releasably positioned in the volume, the drawer may be in toolless engagement with the housing. For example, the toolless engagement between the drawer and the housing may include an interference fit between the drawer and the housing.

In certain implementations, the latch may include a first portion and a second portion, the first portion of the latch is on the cap, the second portion of the latch is on the drawer, and the first portion and the second portion are securable to one another to hold the cap in the closed position. As an example, the first portion and the second portion of the latch may be releasably securable to one another via magnetic engagement of the first portion and the second portion of the latch to one another.

In some implementations, the device may further include a slider and a rail. For example, the rail may be disposed in the volume, the slider is supported on the rail with the slider extending into the cavity, and the slider is movable along the rail to move the slider along an elongate dimension of the cavity. As a more specific example, a portion of the drawer away from the cap may define an opening through which the slider is movable into the cavity of the drawer. In some cases, the rail may be releasably securable to the housing within the volume of the housing.

In certain implementations, the device may further include a second spring mechanically coupled to the slider and to the rail. The second spring may, for example, bias movement of the slider, in the cavity of the drawer, toward the cap. The second spring may be a constant force spring.

BRIEF DESCRIPTION OF DRAWINGS

Like reference symbols in the various drawings indicate like elements.

DETAILED DESCRIPTION

Figure 1A:
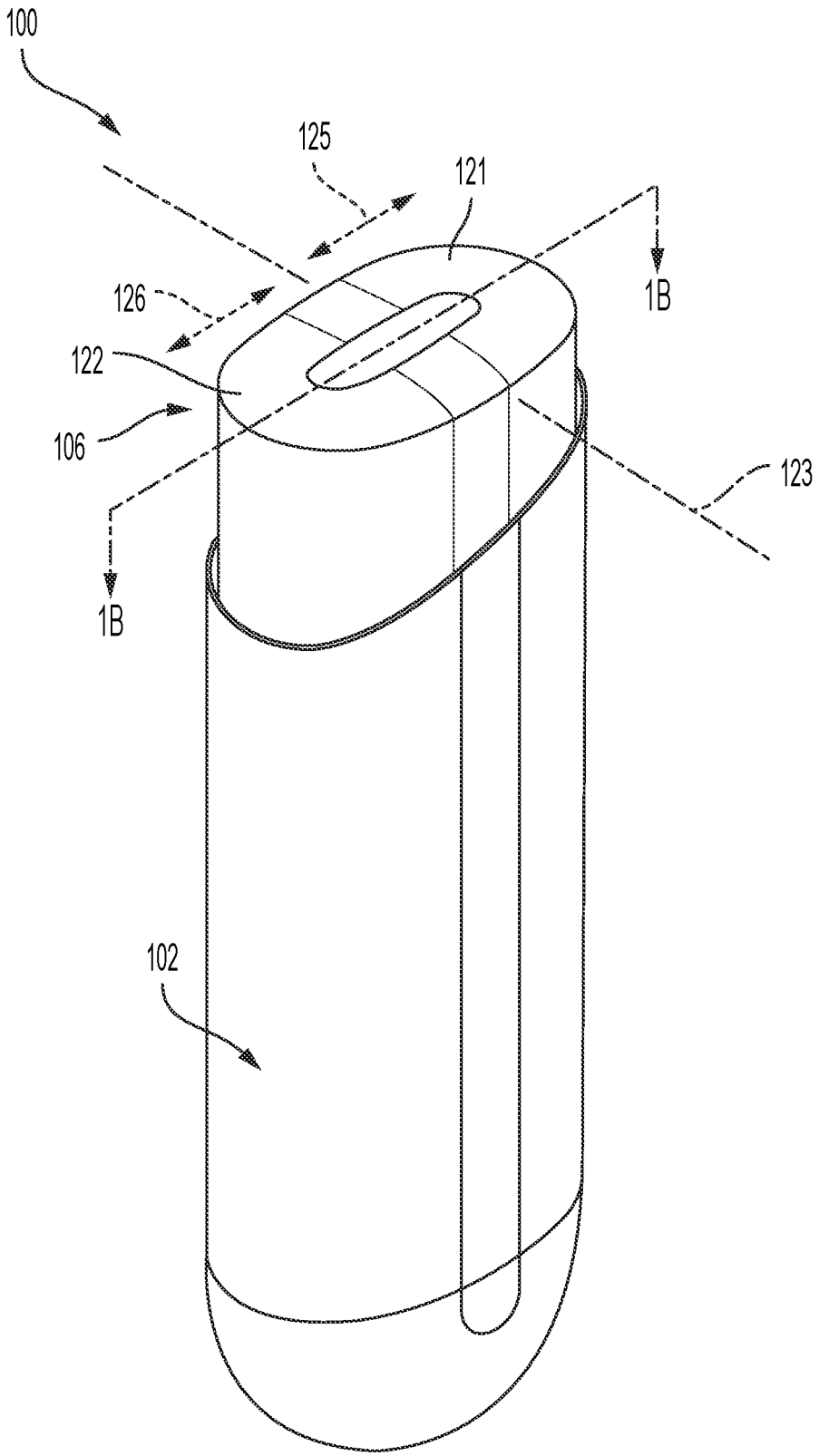
FIG. 1A is a perspective view of a dispensing device including a cap and a housing, with the cap shown in a closed position.
Figure 1B:
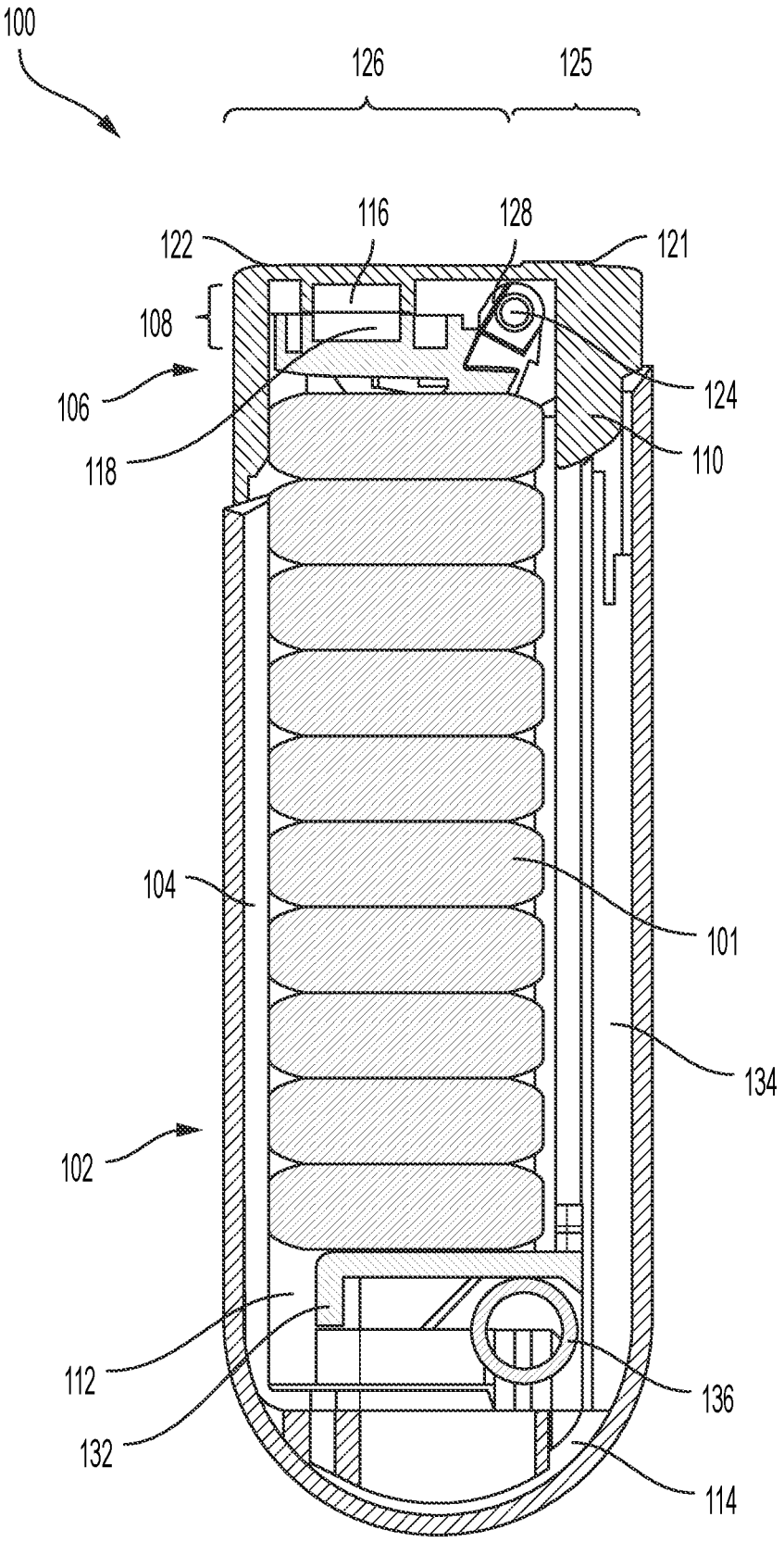
FIG. 1B is a side view of a cross-section of the dispensing device of FIG. 1A, with the cross-section taken along line 1B-1B in FIG. 1A and the dispensing device shown with a full complement of a plurality of consumable units.
Figure 1C:
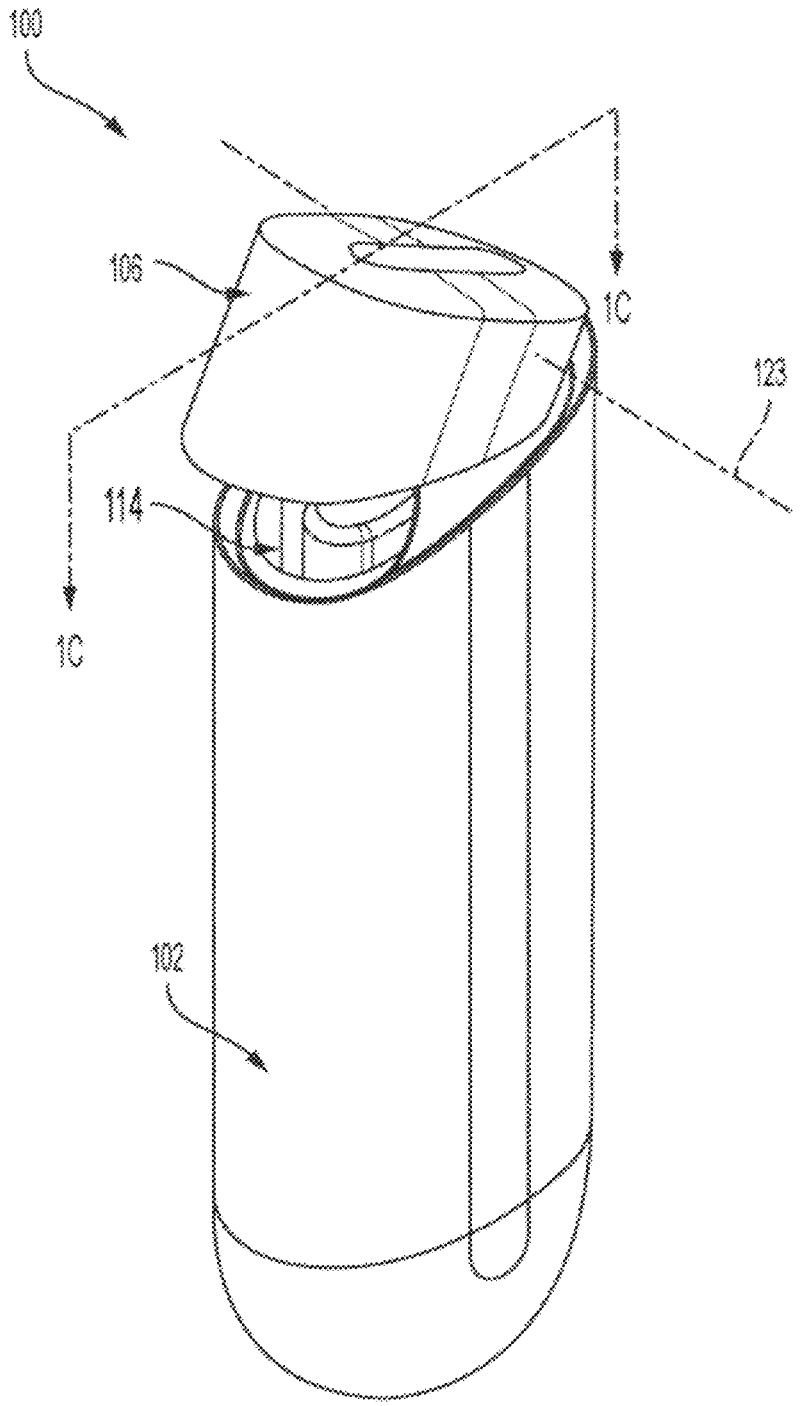
FIG. 1C is a perspective view of the dispensing device of FIG. 1A shown with the cap in the open position.

Embodiments will now be described more fully hereinafter with reference to the accompanying figures, in which exemplary embodiments are shown. The foregoing may, however, be embodied in many different forms and should not be construed as limited to the exemplary embodiments set forth herein.

All documents mentioned herein are hereby incorporated by reference in their entirety. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or," and the term "and" should generally be understood to mean "and/or."

Recitation of ranges of values herein are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as including any deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples or exemplary language ("e.g.," "such as," or the like) is intended merely to better illuminate the embodiments and does not pose a limitation on the scope of those embodiments. No language in the specification should be construed as indicating any unclaimed element as essential to the practice of the disclosed embodiments.

The present disclosure is generally directed to devices and methods of addressing challenges associated with dispensing consumable units from portable dispensing devices. For example, devices and methods of the present disclosure address challenges associated with sanitary dispensation of consumable units according to techniques that are amenable to portability. Additionally, or alternatively, devices and methods described herein address challenges associated with convenient and consistent operability of dispensation within a form factor suitable for portability and personal use, such as for carrying in a pocket, a purse, a backpack, and the like.

As used herein, the term "consumable unit" shall be understood to refer to any one or more of various different types of consumables intended to be ingested (e.g., chewed, swallowed, dissolved, or a combination thereof) and having a discrete form factor. For example, consumable units may include one or more of candy, gum, breath mints, pills, capsules, tablets, chewables, lozenges, dissolve-in-mouth micro-capsules, orally disintegrating tablets, and so forth. While the consumable units may include medication and/or nutritional supplements (e.g., vitamins, minerals, etc.) in some instances, it shall be appreciated that the consumable units may have any one or more of various different compositions as may be suitable for or desirable by a particular a user, a group of users, or a party associated with a user. More generally, the consumable units may be any composition for consumption in individual, individual pre-packaged, group pre-packaged and/or mixed item package form. Further, while dispensing devices and methods of the present disclosure are described as being used to dispense consumable units, it shall be appreciated that this is for the sake of clear and efficient description of various aspects of these dispensing devices and methods. Thus, unless otherwise specified or made clear from the context, the dispensing devices and methods described herein may be used to dispense any one or more of various different types of discrete units that are usefully dispensed manually and in controlled quantities but are not intended for ingestion by the user. An example of such a discrete unit may include a treat for a pet or, in some instances, a discrete unit that is not intended for ingestion at all (e.g., hand sanitizer).

As also used herein, the term "constant force spring" shall be understood to include a roll of a prestressed strip of material that is in a rolled up form when relaxed and, thus, resists uncoiling. In this context, the modifier "constant force" is a term of art used to identify springs including this type of rolled material having an initial force starting from a finite value, instead of from zero. That is, use of the term "constant force" to describe certain types of springs herein is a matter nomenclature in the area of springs and does not necessarily imply or require constant force throughout travel of the spring. For example, unless otherwise specified or made clear from the context, it shall be appreciated that the force exerted by constant force springs described herein may be approximately constant over distances of unrolling required to accommodate different quantities of consumable units in the dispensing devices described herein. Variations in force exerted by constant force springs over the distances associated with the dispensing devices herein shall be understood to be negligible (e.g., imperceptible by a user) or, in any event, less than variations in force that would be observed using other types of springs such as coil springs and the like.

Referring now to FIGS. 1A-1H, a device 100 for dispensing a plurality of consumable units 101 may include a housing 102, a drawer 104, a cap 106, a latch 108, and a tooth 110. The drawer 104 defines a cavity 112 and may be at least partially disposed in a volume 114 defined by the housing 102. The cap 106 may be along the housing 102 to provide selective access to one or more instances of the plurality of consumable units 101. For example, the latch 108 may be securable to hold the cap 106 in a closed position (FIGS. 1A and 1B) enclosing the volume 114 of the housing 102. As described in greater detail below, in response to a force (e.g., force indicated by arrow FF in FIG. 1D) exceeding a threshold force on the latch 108, the cap 106 may be movable from the closed position (FIGS. 1A and 1B) to an open position (FIGS. 1C and 1D) exposing the volume 114. The tooth 110 may be mechanically coupled to the latch 108 such that, in response to the force exceeding the threshold force on the latch 108, the tooth 110 may be movable in the cavity 112 in a direction directing a single instance of the plurality of consumable units 101 out of the volume 114 as the cap 106 moves from the closed position to the open position. For example, as described in greater detail below, the latch 108 and the tooth 110 may be mechanically coupled to one another via the cap 106, and the force of a user depressing a portion of the cap 106 may release the latch 108 and move the tooth 110 through the cavity 112, dispensing a single instance of the plurality of consumable units 101 out of the volume 114 as the cap 106 moves from the closed position to the open position. As may be appreciated from this example, the mechanical coupling between the latch 108 and the tooth 110 may facilitate unlatching the latch 108 and dispensing the single instance of the plurality of consumable units 101 in response to only a single force-such as may be advantageous for single-handed operation of the device 100—while still securely retaining the plurality of consumable units 101 in the device 100 between dispensing events. Thus, as compared to dispensing devices requiring separate movements for unlatching and dispensing elements, the mechanical coupling between the latch 108 and the tooth 110 may reduce the amount of user-manipulation required which may, among other things, facilitate more sanitary dispensing.

In general, the latch 108 may resist small forces, such as those inadvertently applied to the device 100 between uses while the device 100 is in a user's pocket or purse. That is, the latch 108 may hold the cap 106 in the closed position, enclosing the volume 114 of the housing 102, until one or more forces characteristic of deliberate actuation is/are applied to the cap 106. Additionally, or alternatively, the latch 108 may be manually operable (e.g., without the use of a tool, a key, or the like) to facilitate on-demand dispensation of the plurality of consumable units 101 without the need for specialized equipment and with little or no specialized instruction. For the sake of clear and efficient description, the force required to release the latch 108 is generally discussed in terms of a scalar quantity unless a different intent is expressed or made clear from the content. That is, while force is a vector having both a magnitude and a direction, discussion of the force required to release the latch 108 generally assumes that a given force (or a component thereof) has an appropriate direction such that discussion of scalar quantities is appropriate.

Figure 1D:
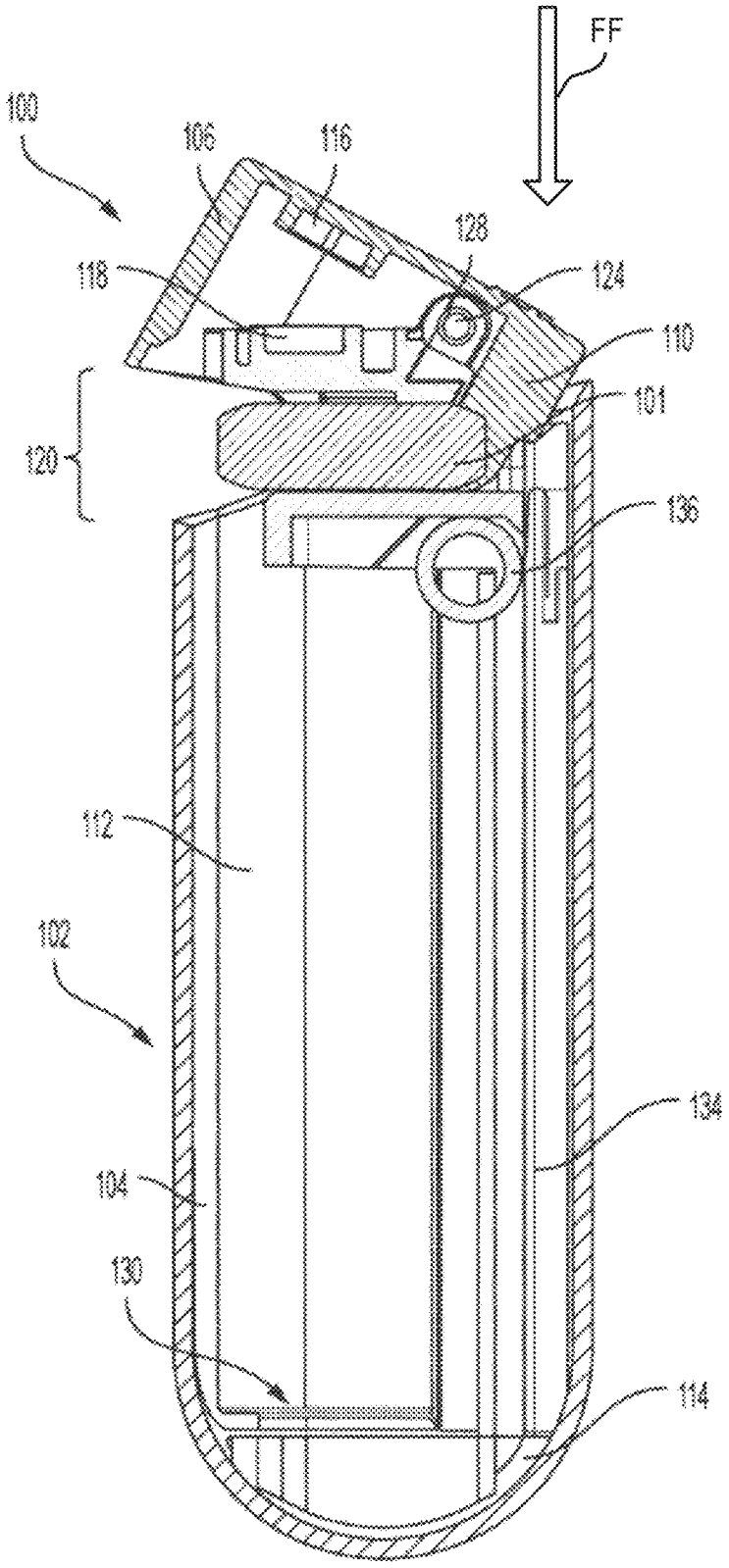
FIG. 1D is a side view of a cross-section of the dispensing device of FIG. 1C, with the cross-section taken along line 1C-1C in FIG. 1C and the dispensing device shown with a single consumable unit.
Figure 2:
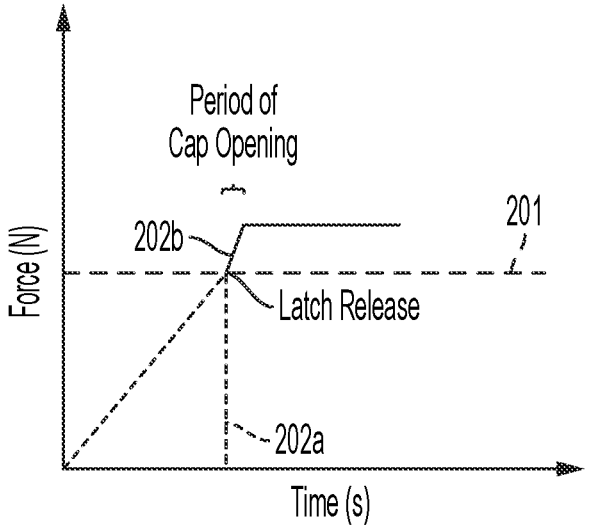
FIG. 2 is a schematic representation of a transfer of force, in the dispensing device of FIG. 1A, from a latch to a tooth as the latch is released at threshold force.
Figure 3:
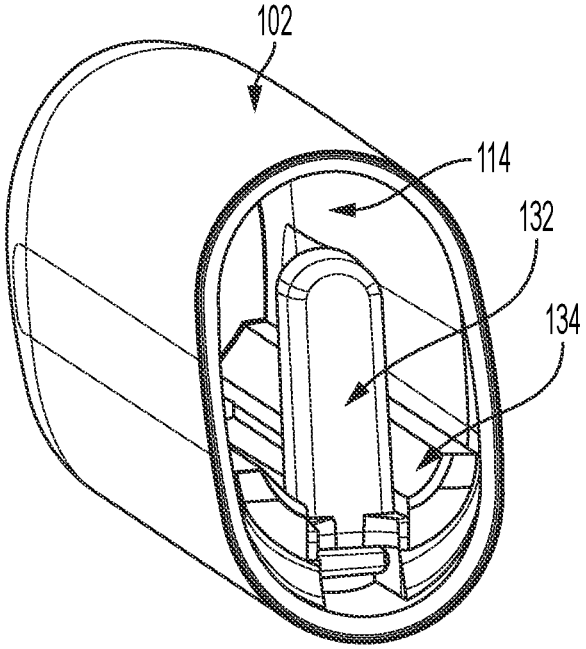
FIG. 3 is a top perspective view of the housing of the dispensing device of FIG. 1A, shown with a rail and slider disposed in a volume defined by the housing.

In certain implementations, referring now to FIGS. 1A-1D and FIG. 2, the latch 108 and the tooth 110 may cooperate with one another to facilitate efficient use of a single activation force applied to the device 100. More specifically, at a threshold force 201 at which the latch 108 is released, a force 202*a* on the latch 108 may be transferrable to the tooth 110 as a force 202*b* to move the tooth 110 in the cavity 112. For example, a single force applied to the cap 106 may be translated into the force 202 on the latch 108 until a threshold force is reached and the latch 108 is released, at which point the force applied to the cap 106 may be directed to the tooth 110 as the force 202*b*. As may be appreciated from this example, the transferability of the force 202*a* on the latch 108 into the force 202*b* to move the tooth 110 may facilitate single-handed operation of the device 100, which is generally useful for convenience and can promote sanitary operation through less handling. It shall be generally appreciated that the variation of the force 202*a* and the force 202*b* with time in FIG. 2 is an idealized example presented for the sake of clear description. Unless otherwise specified or made clear from the context, it shall be understood that the temporal variation of the force 202*a* and the force 202*b* may vary according to one or more of various different conditions, such as mechanical inefficiencies that may exist and/or develop over time. Thus, more generally, it shall be understood that a salient feature of FIG. 2 is the transfer of force delivery as the latch 108 releases at the threshold force 201 and that, in some instances, this transfer may be rapid to the point of being perceived as instantaneous. Unless a contrary intent is explicitly indicated, the terms rapid, instantaneous, or variations thereof shall be understood to refer to transfer of force delivery at the threshold force 201 occurring within a time period beginning immediately after release of the latch 108 at the threshold force 201 and ending when the cap 106 reaches a maximum extent of travel corresponding to the open position of the cap 106.

In some implementations, cooperation between the latch 108 and the tooth 110 with respect to the transfer of forces may further, or instead, facilitate forceful ejection of a single instance of the plurality of consumable units 101, thus reducing the need for a user to reach into the volume 114 to manually remove the single instance of the plurality of consumable units 101. For example, the transfer of the force 202*b* to the tooth 110 may be rapid (e.g., instantaneous) following the force 202*a* on the latch 108 reaching the threshold force 201. That is, the force 202*a* directed to the tooth 110 for engagement with the single instance of the plurality of consumable units 101 may rise from zero (or near zero to the extent there is some relative movement or "play" between assembled parts) to a value just above the threshold force 201 in the form of a step function (or an approximation of a step function, again allowing for relative movement or "play" between assembled parts). Additionally, or alternatively, the force 202*b* may build above the threshold force 201 as force continues to be directed to the tooth 110 in the small amount of time required for the cap 106 to open sufficiently to define the opening 120 through which the single instance of the plurality of consumable units 101 may pass. The net impact of one or both of these mechanisms is a rapid change in the force of the tooth 110 on the single instance of the plurality of consumable units 101 closest to the cap 106 such that this instance may be ejected with some force away from the volume 114 of the housing 102 of the device 100 and into the hand of the user or another receiver. To the extent the dispensed instance of the plurality of consumable units 101 is ejected away from the volume 114, the hand of the receiver does not need to come into contact with one or more instances of the plurality of consumable units 101 remaining in the cavity 112 of the drawer 104. In turn, such reduced contact may reduce the likelihood of contaminating the plurality of consumable units 101 remaining in the cavity 112.

In certain implementations, the latch 108 may include a first portion 116 and a second portion 118. The first portion 116 of the latch 108 may be on the cap 106 and the second portion 118 of the latch 108 may be away from the cap 106, with the first portion 116 and the second portion 118 of the latch 108 securable to one another to hold the cap 106 in the closed position. For example, the second portion 118 of the latch 108 may be along one or more portions of the device 100 that remain stationary throughout dispensation of a single instance of the plurality of consumable units 101, as may be useful for reliably securing and releasing the latch 108. Thus, as a more specific example, the second portion 118 of the latch 108 may be disposed on the drawer 104.

In some instances, the first portion 116 and the second portion 118 of the latch 108 may be releasable from one another in response to the force 202*a* (e.g., a relative force between the first portion 116 and the second portion 118) corresponding to the threshold force 201. As an example, the first portion 116 and the second portion 118 of the latch 108 may be releasably securable to one another via magnetic engagement. That is, the first portion 116 of the latch 108 may include a first magnetic material, and the second portion 118 of the latch 108 may include a second magnetic material. Continuing with this example, as the first portion 116 of the latch 108 and the second portion 118 of the latch 108 are brought into proximity of one another (e.g., with the cap 106 nearly in the closed position), the second portion 118 of the latch 108 may be drawn to the first portion 116 of the latch 108 via magnetic force. Further, this magnetic force may hold the second portion 118 and the first portion 116 of the latch 108 in place, relative to one another, such that the cap 106 may remain in the closed position and resist opening under inadvertent forces less than the magnetic force.

The use of magnetic force to hold the first portion 116 and the second portion 118 of the latch 108 in place relative to one another may be particularly advantageous for, among other things, achieving a rapid (e.g., instantaneous) transfer of forces useful for ejecting a single instance of the plurality of consumables discussed above. That is, because magnetic force drops off significantly with distance, the application of force on the cap 106 to move the second portion 118 of the latch 108 away from the first portion 116 of the latch 108 may result in a rapid release of the second portion 118 from the first portion 116 of the latch 108. Following such rapid release of the latch 108 at the threshold force 201, continued application of force on the cap 106 is translated into the force 202*b* on the tooth 110 to promote ejection of a single instance of the plurality of consumable units 101 from the device 100. In some instances, a rapid release of the latch 108 at the threshold force 201 may result in a large change in resistance of the cap 106 to the applied force such that continued application of the force to the cap 106 following release of the latch 108 may cause the tooth 110 to move rapidly in the cavity 112 to move the single instance of the plurality of consumable units 101 out of the volume 114 of the housing 102. The result may be forceful ejection of the single instance of the plurality of consumable units 101 to facilitate easy and hygienic dispensing, as there is no need to pull the consumable from the device 100. Further, from the foregoing example, it shall be generally appreciated that forceful ejection according to the various different techniques described herein is achievable using energy only from the user directing a force to the cap 106, with such force being applicable through single-handed operation of the device 100.

While the use of magnetic attraction between the first portion 116 and the second portion 118 of the latch 108 has been described as having advantages with respect to being rapidly releasable at the threshold force 201, it shall be appreciated that such magnetic attraction may have additional or alternative advantages. For example, magnetic attraction between the first portion 116 and the second portion 118 of the latch 108 may be generally resistant to degradation in performance over time, thus contributing to consistent performance of the device 100 over time in implementations in which the device 100 is refillable for use over many cycles. Further, or instead, magnetic attraction between the first portion 116 and the second portion 118 of the latch 108 may facilitate securing the latch 108 to hold the cap 106 in the closed position. That is, magnetic attraction may draw the first portion 116 and the second portion 118 of the latch 108 toward one another after a single instance of the plurality of consumable units 101 is dispensed.

While the first portion 116 and the second portion 118 of the latch 108 have been described as being releasably engageable with one another through magnetic force, it shall be appreciated that mechanical force may be additionally, or alternatively, used to releasably secure the first portion and the second portion 118 of the latch 108 to one another. For example, the first portion 116 and the second portion 118 may have complementary features that are engageable with one another through an interference fit.

In general, the cap 106 may be along the housing 102 such that, in the closed position, the cap 106 may enclose the volume 114 of the housing 102 such that the cap 106 and the housing 102 collectively protect the plurality of consumable units 101 in the volume 114 from contamination, as may be particularly important in instances in which the device 100 is carried in an unsanitary environments between dispensing events. To facilitate protecting the plurality of consumable units 101, which may be easily crushed in some instances, one or both of the housing 102 or the cap 106 may be formed of rigid material suitable for withstanding forces associated with typical use of the device 100. For example, the housing 102 and the cap 106 may be formed from a combination of any one or more of the following: aluminum, stainless steel, any other metal, plastic, cloth, wood, fiberglass, composite materials, or a combination thereof. Further, or instead, while the housing 102 and the cap 106 may be formed of the same material in some instances, it shall be understood that the housing 102 and the cap 106 may be formed of different materials, such as may be useful for achieving cost targets.

While the cap 106 may be coupled directly to the housing 102 in some instances, it shall be appreciated that the cap 106 may be additionally, or alternatively, supported by one or more components disposed in the volume of the housing 102 such that coupling between the cap 106 and the housing 102 is indirect. This may be useful, for example, for replacing the cap 106 without necessarily requiring replacement of the housing 102 or vice versa. Further, or instead, this may facilitate positioning the pivoting mechanism of the cap 106 within the volume 114 defined from the housing 102 such that the pivoting mechanism may be protected from damage or contamination that may degrade performance of the pivoting mechanism. More generally, the housing 102 may circumscribe the cap 106 at least when the cap 106 is in the closed position to reduce or eliminate the likelihood of environmental contaminants entering the volume 114 to interfere with the plurality of consumable units 101.

In certain implementations, the force 202*a* on the latch 108 may be transmittable to the latch 108 via depression of at least a portion of the cap 106. For example, the latch may be mechanically coupled to the cap 106 when the cap 106 is in the closed position, and depression of at least a portion of the cap 106 may release the latch 108. Depressing at least a portion of the cap 106 to release the latch 108 may be a particularly useful configuration, as such motion is easily achievable using a thumb press while the device 100 is held between the palm and fingers of the user. While mechanical coupling between the cap 106 and the latch 108 may be direct (such as in instances in which the first portion 116 of the latch is on the cap 106) to facilitate the efficient transfer of force, it shall be appreciated that mechanical coupling between the cap 106 and the latch 108 may be indirect in some instances.

As an example, the cap 106 may include a first section 121 and a second section 122. The cap 106 may be pivotable about a pivot axis 123 between the first section 121 and the second section 122. For example, the cap 106 may be secured to the drawer 104 at least along the pivot axis 123, such as via a pin 124 having a longitudinal dimension along the pivot axis 123. Continuing with this example, depression of the first section 121 of the cap 106 may move the second section 122 of the cap 106 away from the housing 102 to define the opening 120 that exposes the volume 114 and provides a path of egress of a single instance of the plurality of consumable units 101. In certain instances, the first section 121 of the cap 106 may be depressed to a depth limited by one or more mechanical stops on the housing 102 and/or on the drawer 104, as may be useful for providing the user with tactile feedback regarding completion of a dispensing event. In such instances in which the first section 121 and the second section 122 of the cap 106 are pivotable about a pivot axis 123, it shall be appreciated that limiting the range of motion of the first section 121 also limits the range of motion of the second section 122 and, thus, the size of the opening 120 formed by the housing 102 and the cap 106 in the open position. To facilitate forming the opening 120 with a height sufficient to allow passage of each instance of the plurality of consumable units 101 while also maintaining a compact form factor of the device 100, the first section 121 and the second section 122 of the cap 106 may be asymmetric about the pivot axis 123. More specifically, the first section 121 may have a first length 125 pivotable about the pivot axis 123, the second section may have a second length 126 pivotable about the pivot axis 123, and the first length 125 is less than the second length 126. Stated differently, asymmetry between the first section 121 and the second section 122 may provide mechanical advantage such that depressing the first section 121 of the cap 106 to a maximum amount of travel raises second section 122 of the cap 106 to form the opening 120 with a height greater than the maximum amount of travel of the first section 121 of the cap 106.

In some instances, it may be useful to bias the cap 106 from the open position to the closed position to reduce the likelihood that the cap 106 may be inadvertently left in the open position. Further, or instead, biasing the cap 106 from the open position to the closed position may automatically reset the cap 106 to dispense a next instance of the plurality of consumable units 101 such that dispensing multiple instances of the plurality of consumable units 101 requires only depressing the first section 121 of the cap 106 multiple times, with the cap 106 returning to the closed position between each press while the plurality of consumable units 101 move toward the cap 106, as described in greater detail below. Each return of the cap 106 to the closed position may provide the user with tactile feedback and/or audible feedback indicating that the device 100 is reset and ready to dispense a next instance of the plurality of consumable units 101 (assuming that at least one instance of the plurality of consumable units 101 remains in the cavity 112 of the drawer 104, as shown in FIG. 1D). In instances in which no more instances of the plurality of consumable units 101 remain in the cavity 112, the next press of the first section 121 of the cap 106 may be accompanied by no dispensing, thus providing an indication to the user that a refill is needed.

As an example, the device 100 may include a first spring 128 coupled to the cap 106 to bias the cap 106 from the open position to the closed position. The first spring 128 may be any one or more of various different types of springs useful for providing a large amount of spring force in a small amount of space. As an example, the first spring 128 may be a torsion spring. Such a torsion spring may be, for example, rotatable about the pivot axis 123 to resist movement of the cap 106 from the closed position to the closed position when force is applied to the first section 121 of the cap 106. As the force on the first section 121 of the cap 106 is released, the torsion spring may rotate toward a less stressed position to move the cap 106 from the open position to the closed position. In instances in which the latch 108 is releasably securable using magnetic force, it shall be appreciated that the closing force provided by the first spring 128 may augment the closing force resulting from magnetic attraction between the first portion 116 and the second portion 118 of the latch 108.

In general, the tooth 110 may be mechanically coupled to the latch 108 to facilitate transfer of force from the latch 108 to the tooth 110 according to any one or more of the various different techniques described herein. As used in this context, the mechanical coupling between the latch 108 and the tooth 110 may be direct or indirect, as may be useful for achieving a particular force profile. For example, in some instance, the tooth 110 may be mechanically coupled to the latch 108 via the cap 106. More specifically, the tooth 110 may be coupled to the cap 106 and extend in a direction away from the cap 106 while the first portion 116 of the latch 108 is disposed on the cap 106. Continuing with this example, the maximum extent of the tooth 110 away from the cap 106 may be sized according to the nominal width of the plurality of consumable units 101 such that only a single instance of the consumable units 101 is engageable by the tooth 110 moving through the cavity 112. Thus, as the cap 106 rotates about the pivot axis 123 in response to pressing the first section 121 of the cap 106, the tooth 110 may move, about the pivot axis 123, toward the opening 120 with at least a portion of such motion of the tooth 110 being in the cavity 112 to engage a single instance of the plurality of consumable units 101. For example, the tooth 110 may be spaced apart from the pivot axis 123 such that the tooth 110 moves along an arcuate path centered about the pivot axis 123 to move a single instance of the plurality of consumable units 101 out of the volume 114 of the housing 102 via the opening 120 defined by the housing 102 and the cap 106 in the open position. While the movement of the tooth 110 about the pivot axis 123 may be along an arcuate path, it shall be appreciated that such an arcuate path is approximately linear over the short amount of travel of the tooth 110 in the cavity 112 such that most, if not all, of the force of the tooth 110 on the single instance of the consumable unit 101 is translated into ejecting the consumable unit 101 out of the opening 120.

In some implementations, the tooth 110 may be outside of the cavity 112 of the drawer 104 when the cap 106 is in the closed position. This may be useful, for example, for reducing the likelihood that the tooth 110 may interfere with advancement of the plurality of consumable units 101 toward the cap 106 according to the techniques described in greater detail below. In such implementations, the tooth 110 may be movable into the cavity 112 via movement of the tooth 110 about the pivot axis 123 as the cap 106 moves from the closed position to the open position. Similarly, the tooth 110 may be movable out of the cavity 112 as the cap 106 moves from the open position to the closed position. Further, or instead, to facilitate efficient force transmission from the cap 106 to each one of the plurality of consumable units 101 in turn, the tooth 110 may be formed of a rigid material. As an example, the tooth 110 and the cap 106 may be formed of the same material, such as may be useful for forming the tooth 110 and the cap 106 as an integral piece.

In general, the drawer 104 may be releasably securable to the housing 102 to facilitate refilling the cavity 112 with the plurality of consumable units 101. For example, with the drawer 104 releasably positioned in the volume 114, the drawer 104 may be in toolless engagement with the housing 102. As used herein, toolless engagement shall be understood to include any manner and form of engagement fixing the position of the drawer 104 within the volume 114 of the housing 102 without the use of tools, using only the user's hands. As may be readily appreciated, such toolless engagement between the drawer 104 and the housing 102 may facilitate refilling the plurality of consumable units 101 in the cavity 112 under a variety of conditions, with the need for access to tools. For example, the toolless engagement between the drawer 104 and the housing 102 may include an interference fit between the drawer 104 and the housing 102, such as may be useful for ensuring accurate and repeatable alignment of the tooth 110 with respect to the cavity 112 and, thus, with respect to the plurality of consumable units 101 in the cavity 112.

The cavity 112 may be generally sized according to the nominal size of the plurality of consumable units 101 and a number of the plurality of consumable units 101 to be carried in the cavity 112. In particular, the cavity 112 may be sized such that the plurality of consumable units 101 may each have the same orientation as one another in the cavity 112 to facilitate repeatable and reliable dispensing of the plurality of consumable units 101. For example, the plurality of consumable units 101 may be stacked on top of one another in the cavity 112. For example, the cavity 112 defined by the drawer 104 may be U-shaped to facilitate loading the plurality of consumable units 101 into the cavity 112 simultaneously, such as from a tray and/or a package.

Further, or instead, the drawer 104 may be shaped to facilitate movement of the plurality of consumable units 101 along a longitudinal dimension of the cavity 112 as instances of the plurality of consumable units 101 are progressively dispensed. For example, the drawer 104 may include a bottom surface 131 with an orifice 130 as an opening in the base surface 131. The orifice may be sized to facilitate movement of a slider into and out of the cavity 112, as described in greater detail below.

In general, the housing 102 may have a form factor suitable for single-handed operation by a user. For example, the housing 102 may have a circumference graspable between a palm and fingers of a user such that a thumb of the same hand of the user may depress the cap 106 to release a single instance of the plurality of consumable units 101 according to the various different techniques described herein. A length of the housing 102 may be selected to hold a useful number of the plurality of consumable units 101 while also fitting in standard pockets without interference with movement of the person carrying the device 100. In certain instances, the housing 102 may include one or more rounded edges, as may be useful for reducing the likelihood of discomfort when the device 100 is carried a pocket of the user.

Having described various aspects of dispensing the plurality of consumable units 101 from the device 100, attention is now directed to description of movement of the plurality of consumable units 101 within the cavity 112 of the drawer 104 to facilitate dispensing multiple instances of the plurality of consumable units 101 using only repeated actuation of the cap 106. That is, more specifically, techniques for moving the plurality of consumable units 101 in the cavity to reliably and repeatedly position a single instance of the plurality of consumable units 101 relative to the tooth 110 for the next dispensing event will now be described.

Referring now to FIGS. 1A-1H and FIG. 3, the device 100 may include a slider 132 and a rail 134. The slider 132 may be supported on the rail 134 with the slider 132 extending into the cavity 112, and the slider 132 may be movable along the rail 134 to move the slider 132 along an elongate dimension of the cavity 112 such that the slider 132 pushes the plurality of consumable units 101 toward the cap 106. Here, it shall be understood that the force of the slider 132 pushing the plurality of consumable units 101 toward the cap 106 may be less than the threshold force 201 required to release the latch 108 and move the cap 106 from the closed position to the open position. That is, the force of the latch 108 holding the cap 106 in the closed position prevents the force of the slider 132 from pushing the plurality of consumable units 101 to open the cap 106 inadvertently.

While movement of the slider 132 along the rail 134 may be achieved through manual actuation of the slider 132, such manual manipulation may make single-handed operation of the device 100 difficult and, further or instead, may produce varying amounts of force leading to inconsistent dispensing. Thus, in some implementations, the device 100 may further include a second spring 136 mechanically coupled to the slider 132 and to the rail 134. In particular, the second spring 136 may bias movement of the slider 132, along the elongate dimension of the cavity 112 of the drawer 104, in a direction toward the cap 106. Such spring-biased movement of the plurality of consumable units 101 may, for example, reduce or eliminate the need for additional manipulation by the user to move the plurality of consumable units 101 between dispensing events.

As an example, the second spring 136 may be a constant force spring. In this context, a "constant force spring" shall be understood to include a roll of a prestressed strip of material that is in a rolled up form when relaxed and, thus, resists uncoiling. In this context, the modifier "constant force" is a term of art used to identify springs including this type of rolled material having an initial force starting from a finite value, instead of from zero. That is, use of the term "constant force" is a matter nomenclature in the area of springs and does not necessarily imply or require constant force throughout travel of the spring.

Continuing with this example, the second spring 136 may be coiled in a relaxed state when the slider 132 is in a position closest to the cap 106 and in stressed positions when the slider 132 is in positions away from the cap 106. However, given the nature of constant force springs, the force exerted by the second spring 136 in instances in which the second spring 136 is a constant force spring may be approximately constant over distances of unrolling required to accommodate different quantities of the plurality of consumable units 101 in the cavity 112 of the drawer 104. Variations in force exerted by the constant force spring on the plurality of consumable units 101 over the elongate dimension of the cavity 112 of the drawer 104 shall be understood to be negligible (e.g., imperceptible by a user) or, in any event, less than variations in force that would be observed using other types of springs such as coil springs and the like. Thus, in instances in which the second spring 136 is a constant force spring, the second spring 136 may advantageously exert approximately the same amount of force on the plurality of consumable units 101, regardless of how many of the plurality of consumable units 101 remain in the cavity 112 of the drawer 104. Compression springs, by comparison, may fail through buckling and may apply variable amounts of force as the number of consumable units changes after each dispensing event. By comparison, the uniform application of force by the constant force spring on the plurality of consumable units 101 may facilitate uniform and consistent movement of the plurality of consumable units 101 along the cavity 112 in a direction toward the cap 106. Such uniform and consistent movement may, in turn, facilitate repeatable placement of each single instance of the plurality of consumable units 101 relative to the tooth 110, thus facilitate robust repeatability of ejection of the plurality of consumable units 101, even through a rapid sequence of dispensing events.

Further, or instead, because the constant force spring exerts force by returning from a stressed state to a coiled state, it shall be appreciated that instances in which the second spring 136 is a constant force spring may offer advantages with respect to noise. This may be a vast improvement relative to the use of ratcheting to move the plurality of consumable units 101 progressively along the cavity 112 of the drawer 104.

In general, the rail 134 may be secured in place in the volume 114 when the device 100 is in use. Such secure placement is important, for example, for properly positioning the slider 132 relative to the plurality of consumable units 101 and facilitating movement of the slider 132 generally along the elongate dimension of the cavity 112 of the drawer 104. In some implementations, the rail 134 may be glued, welded, fused, and/or coupled to the housing 102 in any desired fashion. To facilitate cleaning the device 100, however, the rail 134 may be releasably securable to the housing 102 within the volume 114 of the housing 102. For example, the rail 134 may be securable to the housing 102 via a snap fit or other toolless engagement.

In certain implementations, the rail 134 may limit the amount of travel of the slider 132 relative to the cavity 112 of the drawer 104. For example, the rail 134 may stop movement of the slider 132 toward the cap 106 at a distance away from the tooth 110 such that the slider 132 does not interfere with movement of the tooth 110 as the last instance of the plurality of consumable units 101 is dispensed from the device 100.

In general, the slider 132 may be sized to contact a lowermost instance of the plurality of consumable units 101 with a consistent and repeatable force. Thus, for example, the slider 132 may include a substantially planar surface engageable with the lowermost instance of the plurality of consumable units 101 to reduce the likelihood that uneven force on the lowermost instance of the plurality of consumable units 101 may damage or inadvertently move the lowermost instance of the plurality of consumable units 101 away from the intended path toward the cap 106.

In certain implementations, the slider 132 may slide along one or more grooves of the rail 134 such that the slider 132 may move along the elongate dimension of the cavity 112 to push the plurality of consumable units 101 toward the cap 106. Additionally, or alternatively, the slider 132 may move into and out of the cavity 112 via the orifice 130 defined by the drawer 104. For example, with a full complement of the plurality of consumable units 101 loaded in the cavity 112, the slider 132 may sit just outside of the cavity 112 until a first one of the plurality of consumable units 101 is dispensed and the second spring 136 moves the slider 132 in a direction toward the cap 106 and, thus, into the cavity 112. Such movement of the slider 132 into and out of the cavity 112 via the orifice 130 defined by the drawer 104 may be particularly useful for loading the drawer 104 (with the full complement of the plurality of consumables) into the volume of the housing 102 with the slider 132 properly placed for movement.

Having described various aspects of the device 100 and methods of dispensing the plurality of consumable units 101 from the device 100, attention is now directed to methods of refilling the device 100 with the plurality of consumable units 101. That is, the device 100 may advantageously be reusable and, once the plurality of consumable units 101 have been dispensed from the device 100, the user may refill the device 100 and continue using the device 100 to dispense the plurality of consumable units 101. As compared dispensing devices that are sealed or otherwise intended for single use, use of the device 100 to dispense the plurality of consumable units 101 may result in less waste.

Figure 1H:
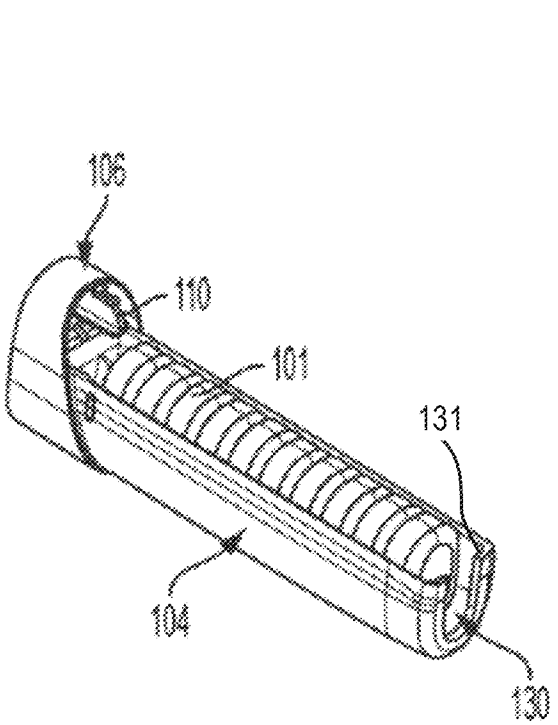
FIG. 1H is a perspective view of the drawer and cap of FIG. 3A, shown with a plurality of consumable units loaded into the drawer.
Figure 1G:
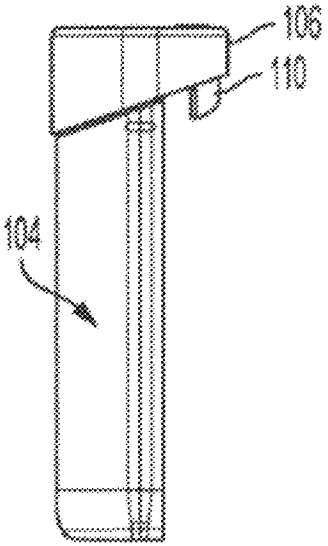
FIG. 1G is a side view of the drawer and the cap of FIG. 3A.
Figure 1F:
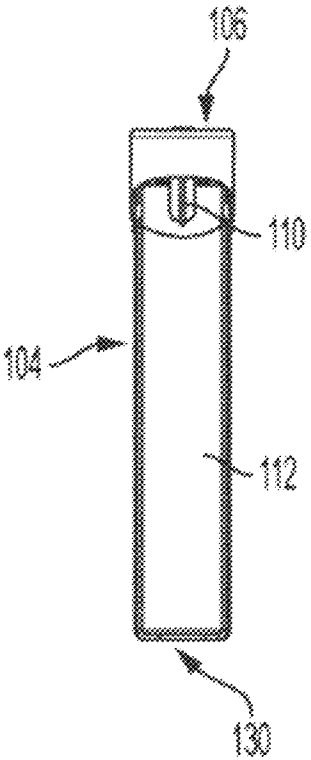
FIG. 1F is a front view of the drawer and the cap of FIG. 3A.
Figure 1E:
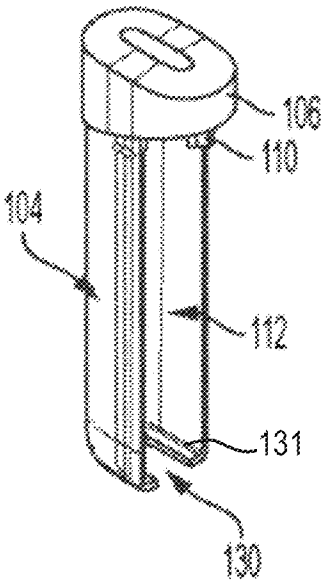
FIG. 1E is a perspective view of a drawer of the dispensing device of FIG. 1A, with the cap shown coupled to the drawer.

To load the plurality of consumable units 101 into the device 100, a user may pull the drawer 104 out of the volume 114 of the housing 102. Advantageously, in instances in which the cap 106 is coupled to the drawer 104, such removal of the drawer 104 may be facilitated by grasping and pulling the cap 106 in a direction away from the housing 102 to release the toolless engagement between the housing 102 and the cap 106 and/or the drawer 104. With the drawer 104 removed from the volume 114, the user may load the tray with the plurality of consumable units 101 (e.g., as shown in FIG. 1H), for example with each one of the plurality of consumable units having the same orientation relative to one another and relative to the drawer 104. As a specific example, the plurality of consumable units 101 may be packaged using a liner tray (e.g., paper wrapping, plastic wrapping, etc.) that is part of disposable packaging of the plurality of consumable units. The user may pull the liner tray from the packaging and use it to load the plurality of consumable units 101 into the drawer 104. While the use of such a liner tray may be useful for loading the plurality of consumable units 101 efficiently, it shall be appreciated that the plurality of consumable units 101 may be loaded into the cavity 112 according to any one or more additional or alternative techniques, including manually.

With the plurality of consumable units 101 loaded in the drawer 104, the orifice 130 of the drawer 104 may be aligned with the slider 132, with the slider 132 positioned in the volume 114. With these components so aligned, the user may slide the drawer 104 in a direction toward the slider 132 and into the volume 114 of the housing 102, thus pushing the slider 132 along the rail 134 in the direction into the volume 114 of the housing 102. In some implementations, the rail 134 may restrict a distance of travel of the slider 306 in the direction into the volume 114 under the force of the drawer 104. As the drawer 104 is moved into the volume 114, the drawer 104 may become releasably secured to the housing via a snap-fit or other toolless engagement. With the drawer 104 releasably secured to the housing 102, it shall be appreciated that the cap 106 secured to the drawer 104 is thus properly positioned to enclose the volume 114 and the plurality of consumable units 101 therein. The cap 106 may then be actuated to dispense the plurality of consumable units 101 as described herein.

While certain aspects of the device 100 have been described, other aspects are additionally or alternatively possible. For example, the device 100 may be sized to allow loading of a predetermined number of the plurality of consumable units 101. Further, or instead, the device 100 may operable to dispense different size, shape, number, etc. of the plurality of consumable units 101. Further or instead, parts of the device 100 may be manufactured from one or more of the following materials: aluminum, stainless steel, titanium, plastic, wood, carbon fiber, alloy, steel, fiber, composite materials, and/or any other suitable material, and/or any combination of materials.

The method steps of the implementations described herein are intended to include any suitable method of causing such method steps to be performed, consistent with the patentability of the following claims, unless a different meaning is expressly provided or otherwise clear from the context. So, for example performing the step of X includes any suitable method for causing another party such as a remote user, a remote processing resource (e.g., a server or cloud computer) or a machine to perform the step of X. Similarly, performing steps X, Y and Z may include any method of directing or controlling any combination of such other individuals or resources to perform steps X, Y and Z to obtain the benefit of such steps. Thus, method steps of the implementations described herein are intended to include any suitable method of causing one or more other parties or entities to perform the steps, consistent with the patentability of the following claims, unless a different meaning is expressly provided or otherwise clear from the context. Such parties or entities need not be under the direction or control of any other party or entity, and need not be located within a particular jurisdiction.

It will be appreciated that the methods and systems described above are set forth by way of example and not of limitation. Numerous variations, additions, omissions, and other modifications will be apparent to one of ordinary skill in the art. In addition, the order or presentation of method steps in the description and drawings above is not intended to require this order of performing the recited steps unless a particular order is expressly required or otherwise clear from the context. Thus, while particular embodiments have been shown and described, it will be apparent to those skilled in the art that various changes and modifications in form and details may be made therein without departing from the scope of the disclosure.

What is claimed:

1. A device for dispensing consumables, the device comprising:

a housing defining a volume;

a drawer slideably disposed in the volume, the drawer defining a cavity to hold a plurality of the consumables in a stacked configuration, wherein the drawer comprises a base support surface and an orifice as an opening in the base support surface;

a cap along the housing;

a latch including a first portion on the cap and a second portion on the drawer, the first portion and the second portion enveloped by the cap in a closed position, the first portion and the second portion releasably securable to one another via magnetic engagement of the first portion and the second portion to hold the cap in the closed position enclosing the volume and, in response to a force depressing an outer surface of the cap exceeding a threshold force of the magnetic engagement of the first portion and the second portion of the latch, the cap movable from the closed position to an open position exposing the volume; and a tooth mechanically coupled to the latch and, in response to the force depressing the outer surface of the cap exceeding the threshold force of the magnetic engagement of the first portion and the second portion of the latch, wherein the force depressing the outer surface of the cap is transferrable to the tooth to move the tooth in the cavity in a direction directing one of the consumables out of the volume as the cap moves from the closed position to the open position;

a slider; and a rail extending along an inner surface of the housing, wherein the rail is disposed in the volume, the slider is supported on the rail, extends from the rail into the volume, and is movable along the rail and biased towards the cap to move the slider along an elongate dimension of the cavity, wherein the slider is configured to pass-through the orifice in the base support surface and is configured to apply a pressing force to push the consumables towards the cap.

2. The device of claim 1, further comprising a second spring mechanically coupled to the slider and to the rail, wherein the second spring biases movement of the slider, in the cavity of the drawer, toward the cap.

3. The device of claim 2, wherein the second spring is a constant force spring.

4. The device of claim 1, wherein the cap includes a first section and a second section, the cap is pivotable about a pivot axis between the first section and the second section, and the force depressing the first section of the cap moves the second section of the cap away from the housing to define a housing opening exposing the volume.

5. The device of claim 4, wherein the first section has a first length pivotable about the pivot axis, the second section has a second length pivotable about the pivot axis, and the first length is less than the second length.

6. The device of claim 4, wherein the cap is coupled to the drawer at least along the pivot axis.

7. The device of claim 4, wherein the tooth is mechanically coupled to the latch via the cap, and the tooth is movable, about the pivot axis, toward the housing opening in response to depression of the first section of the cap.

8. The device of claim 7, wherein the tooth is movable into and out of the cavity via movement of the tooth about the pivot axis.

9. The device of claim 4, further comprising a first spring coupled to the cap, wherein the first spring biases the cap from the open position to the closed position.

10. The device of claim 9, wherein the first spring is a torsion spring rotatable about the pivot axis.

11. The device of claim 1, wherein the housing circumscribes the cap in the closed position.

12. The device of claim 1, wherein the drawer is configured to slide out of and separate from the housing for reloading of the consumables, and wherein the consumables are contained within the cavity the base support surface when the drawer is separated from the housing for reloading.

13. The device of claim 1, wherein, with the drawer releasably positioned in the volume, engagement between the drawer and the housing includes an interference fit between the drawer and the housing.

14. The device of claim 1, wherein a portion of the drawer away from the cap defines an opening through which the slider is movable into the cavity of the drawer.

15. The device of claim 1, wherein the rail is releasably securable to the housing within the volume of the housing.

16. The device of claim 1, wherein the cap is pivotally connected to the drawer and wherein the drawer is configured to slide out of and separate from the housing for reloading of the consumables.

17. The device of claim 1, wherein the slider is biased towards the cap via a spring.

18. A device for dispensing consumables, the device comprising:

a housing defining a volume;

a drawer slideably disposed in the volume, the drawer defining a cavity to hold a plurality of the consumables in a stacked configuration, wherein the drawer comprises a base support surface and an orifice as an opening in the base support surface;

a cap along the housing;

a latch including a first portion on the cap and a second portion on the drawer, the first portion and the second portion enveloped by the cap in a closed position, the first portion and the second portion releasably securable to one another via engagement of the first portion and the second portion to hold the cap in the closed position enclosing the volume and, in response to a force depressing an outer surface of the cap exceeding a threshold force of the engagement of the first portion and the second portion of the latch, the cap movable from the closed position to an open position exposing the volume; and a tooth mechanically coupled to the latch, wherein a force depressing the outer surface of the cap is transferred to the tooth to move the tooth to directing one of the consumables out of the volume as the cap moves from the closed position to the open position, in response to the force depressing the outer surface of the cap exceeding the threshold force of the engagement of the first portion and the second portion of the latch;

a slider; and a rail extending along an inner surface of the housing, wherein the rail is disposed in the volume, the slider is supported on the rail, extends from the rail into the volume, and is movable along the rail and biased towards the cap to move the slider along an elongate dimension of the cavity, wherein the slider is configured to pass-through the orifice in the base support surface and is configured to apply a pressing force to push the consumables towards the cap.

19. The device of claim 18, wherein the cap is pivotally connected to the drawer and wherein the drawer is configured to slide out of and separate from the housing for reloading of the consumables.

20. The device of claim 18, wherein the slider is biased towards the cap via a spring.

21. The device of claim 18, wherein the drawer is configured to slide out of and separate from the housing for reloading of the consumables, and wherein the consumables are contained within the cavity the base support surface when the drawer is separated from the housing for reloading.

* * * * *